US010483629B1

(12) United States Patent
Silva

(10) Patent No.: US 10,483,629 B1
(45) Date of Patent: Nov. 19, 2019

(54) ANTENNA BEAM POINTING SYSTEM

(71) Applicant: Octavio Cesar Silva, Yorba Linda, CA (US)

(72) Inventor: Octavio Cesar Silva, Yorba Linda, CA (US)

( * ) Notice: Subject to any disclaimer, the term of this patent is extended or adjusted under 35 U.S.C. 154(b) by 0 days.

(21) Appl. No.: 15/924,208

(22) Filed: Mar. 17, 2018

Related U.S. Application Data

(60) Provisional application No. 62/474,045, filed on Mar. 20, 2017.

(51) Int. Cl.
*H01Q 1/28* (2006.01)
*H01Q 3/30* (2006.01)
*H01Q 3/08* (2006.01)

(52) U.S. Cl.
CPC ..... *H01Q 1/28* (2013.01); *H01Q 3/08* (2013.01); *H01Q 3/30* (2013.01)

(58) Field of Classification Search
None
See application file for complete search history.

(56) References Cited

U.S. PATENT DOCUMENTS 5,936,570 A 8/1999 Ghazvinian et al.
6,016,120 A * 1/2000 McNabb ..... H01Q 1/1257 342/357.36
6,377,211 B1 * 4/2002 Hsiung ..... H01Q 1/3275 342/359
7,715,783 B2 * 5/2010 Girard ..... H01Q 1/28 455/3.02

* cited by examiner

*Primary Examiner* — Daniel Swerdlow

(57) ABSTRACT

The Antenna Beam Pointing System is a novel system and method to point a satellite terminal antenna beams to a satellite in near-circular orbit. Unlike other methods, the system described herein relies on the satellite orbital equations of motion to estimate its position with any precision, using a finite-term algebraic expression, and the satellite terminal position information. The system can point to the satellite as a function of the beamforming capabilities of the phased array antenna or the driving system of a mechanically steered antenna. Satellite acquisition could be attained within one second because of the long-term prediction of the orbital equations of motion with programmed initial orbit conditions and the antenna beamwidth which is wide enough to encompass the satellite uncertainty box in orbit. The system could be used with a beacon signal strength indicator or a correlating signal. The system is also applicable for satellites in elliptical orbits.

5 Claims, 12 Drawing Sheets

ANTENNA BEAM POINTING SYSTEM

CROSS REFERENCE TO RELATED APPLICATIONS

This is non-provisional patent submittal corresponding to provisional patent application No. 62/474,045, submitted on Mar. 20, 2017.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

Figure 1:
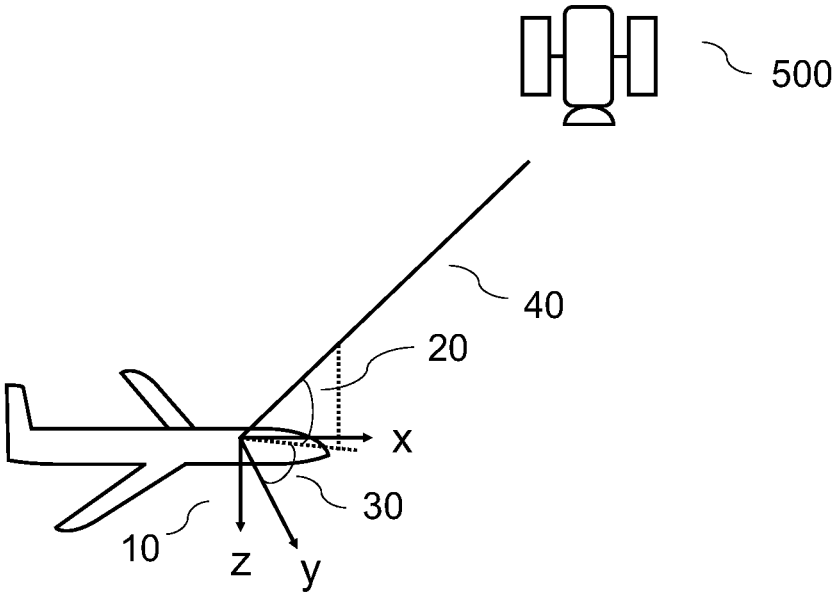
FIG. 1 shows the antenna pointing angles with respect to the position of a low earth orbit satellite.

The present invention relates generally to antenna beam pointing systems and more specifically to an antenna beam pointing system part of a satellite terminal that can autonomously point from cold start to any low earth orbit satellite within view in a satellite constellation, using the satellite orbital equations of motion and the terminal position, and that can track such a satellite subsequently, using these equations or in conjunction with a tracking signal.

Current methods rely primarily on ephemeris readings, satellite search, and subsequent tracking of the satellite with a tracking signal, such as a beacon, or other correlating signal. Initial acquisition of the satellite in view from cold start using these methods can take too long. The present invention is capable of pointing to the satellite and acquire it within one second.

SUMMARY OF THE INVENTION

The Antenna Beam Pointing System is a novel system and method to point a satellite terminal antenna receive and transmit beams to a satellite in near-circular orbit. This method is pertinent to upcoming broadband satellite constellations such Starlink, Telesat, OneWeb, LeoSat and others from Boeing and Thales. Unlike, other methods, the system described herein relies on the satellite orbital equations of motion to estimate the orbit with any precision, using a finite-term algebraic expression. It also, makes use of the terminal position information, which in the case of an aircraft, can be obtained from the inertial reference system (IRS) and a GPS receiver. U.S. Pat. No. 5,936,5670, Low-Earth Orbit Satellite Acquisition and Synchronization System Using a Beacon Signal, describes a method that relies on satellite search and acquisition of the satellite beacon. This method has innate latency disadvantages when a communication link needs to be acquired in a short time frame, typically in less than second. The system described herein can point to the satellite "instantaneously" as a function of the beam forming capabilities of the terminal phased array antenna or the driving system of a mechanically steered antenna. This is possible because the antenna beamwidth is wide enough to encompass the uncertainty box in the satellite orbit. The terminal described herein is programmed with the satellite orbital equations for the whole constellation which is not a daunting task since only the initial conditions for each satellite are required, meaning a file less than 10 MB would be required. When the terminal is ready to acquire the link, it computes the satellite position overhead, and, using its own position information, it commands the antenna to form the beam and point to the desired location. The satellite constellation ground segment can update the terminal with the constellation ephemeris to update its equations once the aircraft is flying. Nevertheless, the equations can predict the overhead satellite position reliably without any external updates under normal satellite station-keeping. This has to be evaluated perspectively since aircraft are only out of service for about two weeks in most cases. Even during long out-of-service periods, the aircraft terminal can be updated with the satellite orbit equations from the satellite constellation ground segment via a terrestrial link before entering service.

DETAILED SUMMARY OF THE INVENTION

As shown in FIG. 1, the system calculates an antenna beam pointing angles: The elevation angle el 20 and the azimuth angle az 30 to follow the direction of the pointing vector 40 towards the satellite. The antenna is installed on the upper fuselage of an aircraft 10 and the beam is directed toward a low earth orbit satellite 500, part of a satellite constellation.

Figure 2A:
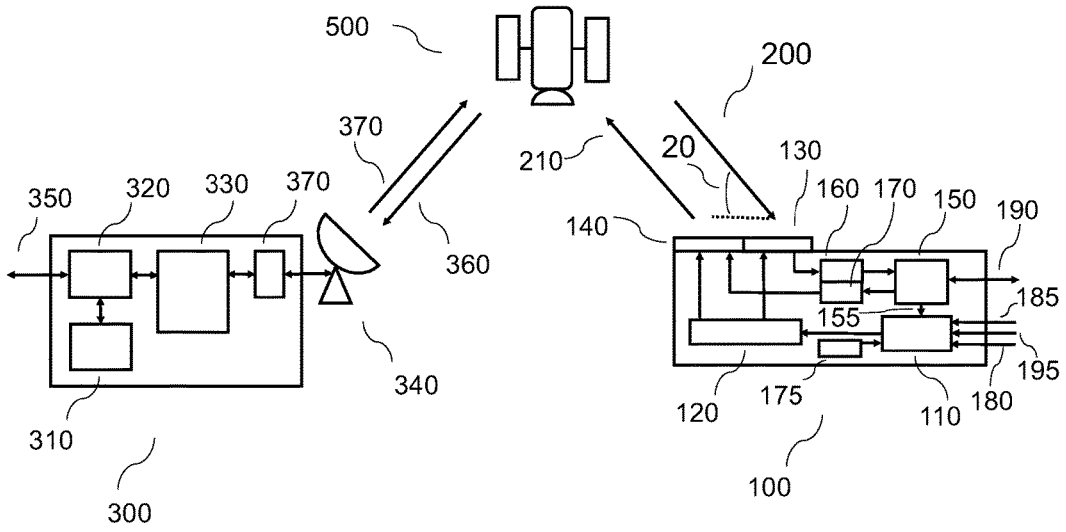
FIG. 2*a* shows the system elements.
Figure 2B:
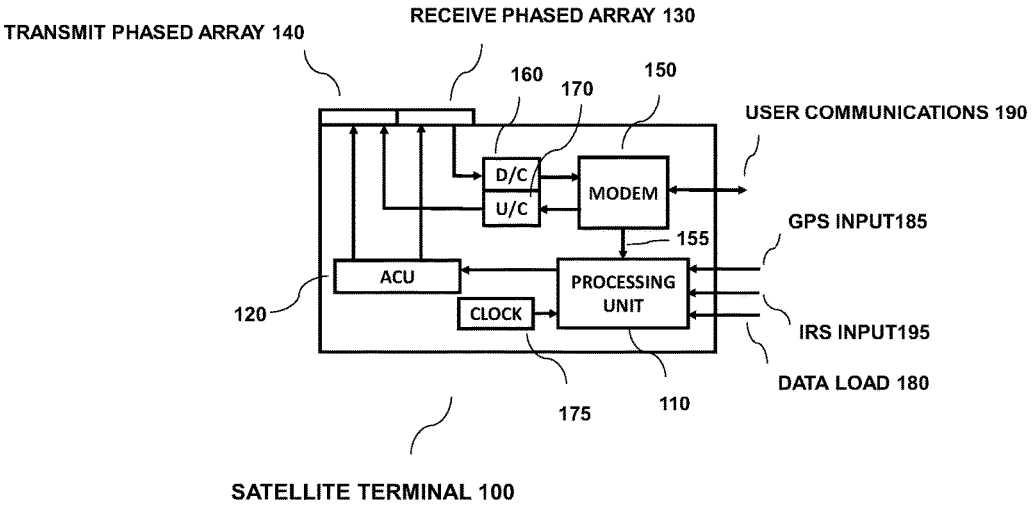
FIG. 2*b* shows the terminal elements.
Figure 2C:
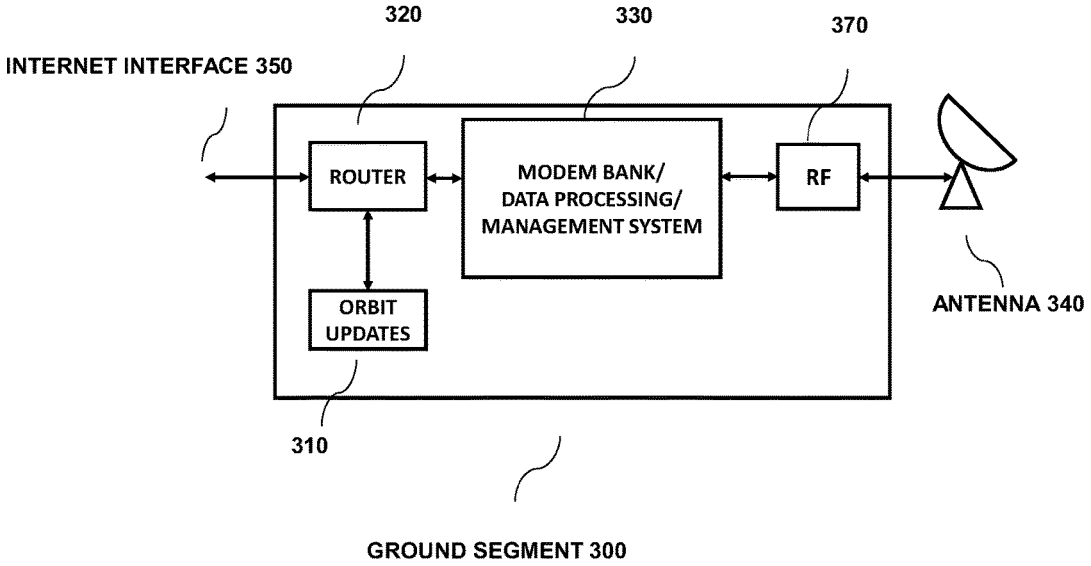
FIG. 2*c* shows the ground station elements.

As shown in FIG. 2*a*, FIG. 2*b* and FIG. 2*c*, the antenna beam pointing system consists of the aircraft terminal 100, the ground station 300 and the satellite 500. The aircraft terminal 100 consists of a processing unit 110, an antenna control unit 120, a receive phased-array panel 130, a transmit phased-array panel 140, which are part of the same antenna, a modem 150, a data load input 180, a GPS input 185, an IRS input 195, a downconverter 160, an upconverter 170, and a clock 175. The data load input 180 programs the processing unit with the algorithm to point. The GPS unit provides position and time information. The elevation angle el 20 is shown on the azimuth plane for the receive beam in the terminal downlink 200. The transmit antenna has a separate beam in the uplink 210 with the same elevation angle.

The processing unit 110 computes the elevation and azimuth angles based on the satellite position and aircraft position using the pointing algorithm with the initial conditions, the GPS inputs 180, IRS inputs 195 and optionally a clock 175. Once, it computes these angles, it sends that information to the ACU 120 which computes the beamforming configuration and sends that information to the receive antenna 130 and the transmit antenna 140 to point each beam.

The ground station 300, part of the ground segment, is comprised of an orbit updates unit 310, a router 320, a modem bank and data processing and management system 330, an RF front end 370, an antenna 340. It receives and transmits simultaneously to the aircraft terminal via a downlink 360 and an uplink 370. The router 320 provides the Internet Protocol (IP) processing and the interface 350 to the Internet.

The satellite 500 is part of the constellation and provides the space-based communication services.

Once the terminal acquires the communications signals sent by the ground station 300, the ground station 300 can send orbital updates using information from the orbit updates unit 310. The modem 150 receives that information and provides a relay 155 to the processing unit 110. During normal operations, the modem 150 also provides the interface 190 to user Internet communications in the aircraft.

The LEO satellite 500 follows a near-circular orbit. GPS provides coordinates using WGS-84 with respect to a geodetic reference system. The aircraft position uses a geocentric reference to allow the use of spherical trigonometry. This provides enough accuracy to allow the receive phased-array antenna 1 dB beamwidth to encompass the orbital uncertainty box. Other beamwidths can be acceptable depending on tolerable link losses for the same aperture and frequency (e.g. a larger 2 dB beamwidth). Corrections can be made to the geocentric model with respect to the geodetic model but the antenna beam pointing would not vary significantly. The receive antenna beam and the transmit antenna beam can be pointed simultaneously but the receive beam is first in priority since the satellite signal has to be acquired first.

The equations that describe satellite motion are included in: "Autonomous Low Earth Orbit Station-Keeping with Electric Propulsion", Andrea Garulli et al, Università degli Studi di Siena, Siena, 53100, Italy, and "Orbit Propagation and Determination of Low Earth Orbit Satellites", Ho-Nien Shou, International Journal of Antennas and Propagation Volume 2014, May 8, 2014.

The equations for satellite motion are:

Vectors are in boldface;

$$\dot{v}_x = a^x_{GEO} + a^x_{Nbod} + a^x_{Rad} + a^x_{Mag} + \frac{F_x}{m} + \frac{p^x}{m} + \Omega_e^2 x + 2\Omega_e \dot{y}; \quad (1)$$

$$\dot{v}_y = a^y_{GEO} + a^y_{Nbod} + a^y_{Rad} + a^y_{Mag} + \frac{F_y}{m} + \frac{p^y}{m} + \Omega_e^2 x + 2\Omega_e \dot{x}; \quad (2)$$

$$\dot{v}_z = a^z_{GEO} + a^z_{Nbod} + a^z_{Rad} + a^z_{Mag} + \frac{F_z}{m} + \frac{p^z}{m}; \quad (3)$$

$$a_{GEO} = dU/dr \quad (4);$$

$$H_{20} = \frac{1}{r^3}\frac{1}{2}(3\sin^2\theta - 1); \quad (5)$$

$$U = \left(-\frac{\mu}{r} + J_2 \mu H_{20}\right); \quad (6)$$

the second term, $J_2$ term, is the dominant component in the JGM-3 model, so higher terms are neglected; the same applies to the EGM-96 model but higher terms can be included for further refinements;

x, y, z=Rectangular coordinates;

v=satellite velocity;

$a_{GEO}$=acceleration due to geopotential;

$a_{Nbod}$=acceleration due to gravitational force from the Sun and the Moon;

$a_{Mag}$=acceleration due to magnetic field;

$a_{Rad}$=acceleration due to solar radiation;

U=geopotential;

F=drag force;

p=Thrust;

$\Omega_e$=Earth angular velocity;

μ=Earth gravitational parameter;

m=mass of satellite;

r=position vector;

$J_2 = 1.7555 \times 10^{10}\ km^5 \cdot s^{-2}$.

LEO satellites can maintain orbit precision indefinitely with station keeping. This accuracy meets the needs of an airplane's phased-array antenna pointing system since, even when they are under maintenance, most airplanes can enter service within one month during a downtime. In addition, a terrestrial network connection can be available to update the satellite ephemeris when the airplane is ready to re-enter service.

The orbit precision of the satellites means that the same orbital equations can be used without modification when station keeping is performed for orbital drifts. In essence, equations that estimate the orbit by an algebraic expression with a finite number of terms is all that can be required to observe the satellite in their ideal orbits when station keeping is factored in. Satellite station keeping control has improved recently to maintain satellites within tight bounds in orbit. The algebraic approximations to the satellite position vector r are shown in the paragraphs below.

Station-keeping allows the satellites to remain in near-ideal orbits within the orbit position uncertainty box. For example, for Iridium, the in-track uncertainty is +/−6 km and the cross track +/−0.08 deg with respect to next plane neighbors. For broadband satellites, the aircraft receive antenna 1 dB beamwidth covers the uncertainty box. Thus, in computing the algorithm, the thrust p may be assumed to counter $a_{GEO}$, $a_{Nbod}$, $a_{Mag}$, $a_{Rad}$, and F to maintain the satellite within the uncertainty box. Therefore, for purposes of satellite position calculations, the velocity due to geopotential only is adequate enough to predict the uncertainty box. As mentioned before, technology improvements have refined station keeping procedures even with respect to Iridium whose technology dates to the 1990's, meaning that the track uncertainty box can be much smaller. In addition, aircraft position uncertainty due to the errors introduced by GPS receivers or IRS is negligible since this error is much smaller than the altitude of the satellites.

A. H. Cook describes equations of satellite motion in "The Contribution of Observations of Satellites to the Determination of the Earth's Gravitational Potential", A. H. Cook, Standards Division, National Physical Laboratory, Teddlington, Middelsex, England, Apr. 2, 1963. These equations can be used to estimate the position of the satellite at any instant of time.

Figure 3:
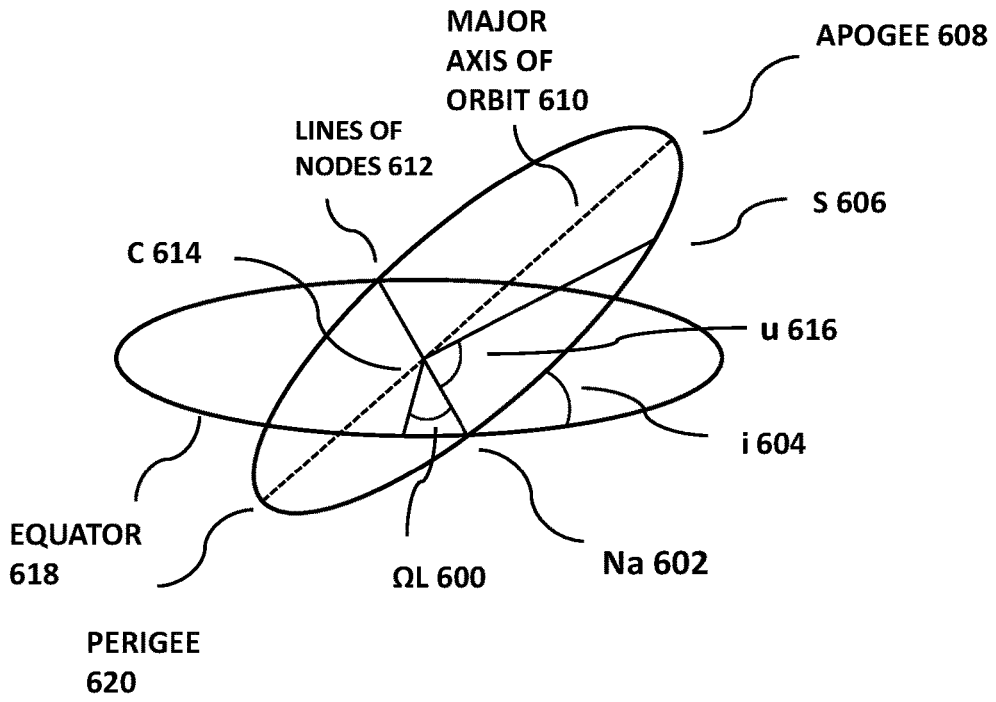
FIG. 3 shows the orbit parameters.
Figure 4:
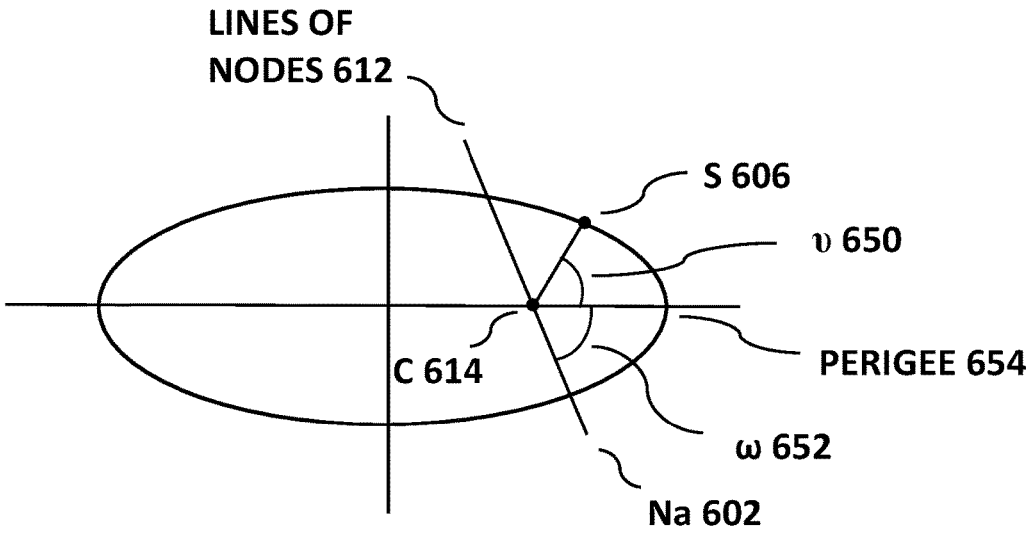
FIG. 4 shows the orbit plane parameters.

The orbit described in Cook's paper is shown in FIG. 3 and FIG. 4. The following nomenclature is used in these figures:

Na 602=ascending node;

ΩL 600=longitude of the node;

S 606=position of the satellite;

i 604=orbit plane inclination;

u 616=argument of latitude;

ν 650=true anomaly or true longitude;

ω 652=longitude of pericenter;

a=semi major axis of ellipse;

e=eccentricity of ellipse.

Cook relates on page 358, "The orientation of the plane of the orbit is space is defined by reference to a fixed plane, the equator for satellites of the Earth. The two planes intersect along the lines of nodes and the angle between them is called the inclination. If CX is some direction fixed in space and if Na 602 is the ascending node, the one at which the satellite passes from south to north across the equator, then the angle between CX and CNa measured in the same direction as the motion of the satellite is called the longitude of the node and is denoted by ΩL 600. If S is the position of the satellite, the angle SCNa is called the argument of latitude, u 616." "P is the position of pericentre (perigee for the Earth). The angular distance of the satellite from the pericentre is called the true longitude or true anomaly and will be denoted by ν 650 in this article—there is a variety of usage. The angular position of the pericentre measured from the ascending node is called the longitude of pericentre and is denoted by ω 652." "The parameters so far defined fix the direction for the satellite in relation to axes fixed in space."

Figure 5:
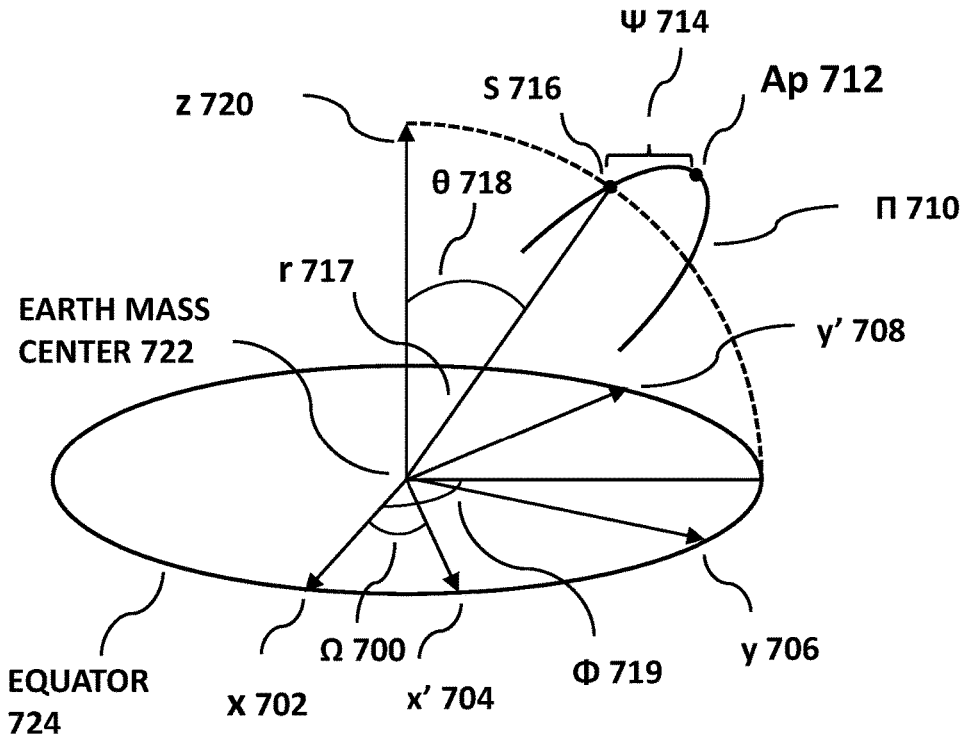
FIG. 5 shows the orbit instantiation to compute the satellite position vector.

Cook describes equations for the satellite position vector on p. 382. Cook relates on page 380 King-Hele's theory that takes a reference plane with a fixed inclination to the equator and forces it to rotate so that it shall always contain the satellite. As shown in FIG. 5, the plane of reference Π 710 contains the center of the Earth O 722 and the satellite S 716. "Oxyz are axes fixed in direction, Oz 720 being directed northwards along the polar axis. Ox' 704 y' 708 z are rotating axes. Oz coincides with Oz 720 in the fixed system, while Ox' 704 is the direction in which Π 710 cuts the plane of the equator 724. The angle xOx' is denoted by Ω 700 measured in the opposite direction to the motion of the satellite 716. The fixed inclination of the plane Π 710 is called α. The spherical polar co-ordinates of the satellite, (r 717, θ 718, ϕ 719) are shown in FIG. 5, measured relative to the fixed axes. Ap 712 is the point of maximum latitude of the satellite, β is the angle between this point and perigee and Ψ 714 is the angle between Ap 712 and S 716."

Cook also relates on page 383 that "Message has discussed the relation between constant inclination for the reference plane chosen by King-Hele and the changing inclination of the osculating plane. Let Oxyz be a moving frame of reference in the plane π 710 of fixed inclination, so that Ox is the intersection of this plane with the equator, Oy the northerly line of greatest slope in the plane, and Oz the direction perpendicular to the plane. The position vector in terms of this frame is":

$$r=(-r\sin\psi, r\cos\psi, 0) \quad (7);$$

"Now let OXYZ be an inertial frame of reference with the plane OXY being the equatorial plane; the angle Ω in King-Hele's theory is the angle between Ox and OX, measured in the opposite direction to Ψ." The position vector then becomes, $$r=(r\sin\Psi\cos\Omega+r\cos\Psi\cos\alpha\sin\Omega, r\sin\Psi\sin\Omega+r\cos\Psi\cos\alpha\cos\Omega, r\cos\Psi\sin\alpha) \quad (8);$$

Where α is the mean inclination;

Cook provides expressions for r, ψ, Ω from which a value of r can be derived. r can be considered the mean value $r_m$. The expressions are valid for orbit eccentricities less than 0.04 which is the case for most LEO orbits. First order variations are as follows:

$$\frac{d\Psi}{dt}=\mu\frac{1}{r_m^2}\left\{1+\frac{3}{2}J_2\left(\frac{R}{p}\right)^2\sec\alpha\sin\theta\right\}+O(J_2e); \quad (9)$$

$$\frac{d\Omega}{dt}=-\frac{3}{2}J_2\frac{\mu p}{r_m^2}\left(\frac{R}{p}\right)^2\cos\alpha; \quad (10)$$

Where $r_m$ is the mean value of the of the position vector, R is the radius of the Earth, p is the semi lactus rectum, μ=GM (M is Earth mass);

$$\frac{1}{r_m^3}=\frac{1+\frac{3}{2}e^2}{a^3(1-e^2)^3}; \quad (11)$$

where a is the semi major axis and e the eccentricity.

Similarly, Kozai describes equations for the mean elements in "The Motion of a Close Earth Satellite", Yoshihide Kozai, Smithsonian Astrophysical Observatory and Harvard College Observatory, Oct. 30, 1959. These equations can provide further accuracy to the position vector coordinates. First order secular expressions and short periodic variations of the first order are provided. Long periodic perturbations and the secular perturbations of the second order can also be derived. As shown on p. 386 in Cook's paper, (p. 372 in Kozai's paper), the first order secular parts are:

$$\omega_{ave}=\omega_o+\frac{3}{4}J_2\left(\frac{R}{p}\right)^2(4-5\sin^2 i)n_{ave}t; \quad (12)$$

$$\Omega_{ave}=\Omega_o-\frac{3}{2}J_2\left(\frac{R}{p}\right)^2 n_{ave}t\cos i; \quad (13)$$

$$M_{ave}=M_o+n_{ave}t \quad (14);$$

$$n_{ave}=n_o+\frac{3}{2}J_2\left(\frac{R}{p}\right)^2 n_o\left(1-\frac{3}{2}\sin^2 i\right)(1-e^2)^{\frac{1}{2}}; \quad (15)$$

where R is the Earth's radius (not to be confused with the disturbing function R in Kozai's paper), i is the inclination of the plane, M is the mean anomaly, ω argument of perigee, μ=GM (M Earth mass). Expressions for these that include the short-periodic and long-periodic perturbations are shown in equations (31) in Kozai's paper. Kozai's conditions also apply to elliptical orbits in general in which case the value of r varies. Thus, when satellites operate in elliptical orbits, ground and airborne terminals can steer the antenna beam, using the same equations. In this case, the more general expression for the magnitude of the radius is:

$$r=a(1-e\cos E) \quad (16);$$

$$M=E-e\sin E \quad (17);$$

where a is the semi major axis and E is the eccentric anomaly.

The computation of r is not limited to Cook's or Kozai's equations. As Cook describes, there are other solutions to obtain r. What is important is that the orbital mechanics equations be written as a finite-term algebraic expression to approximate r to any degree of accuracy.

Figure 6:
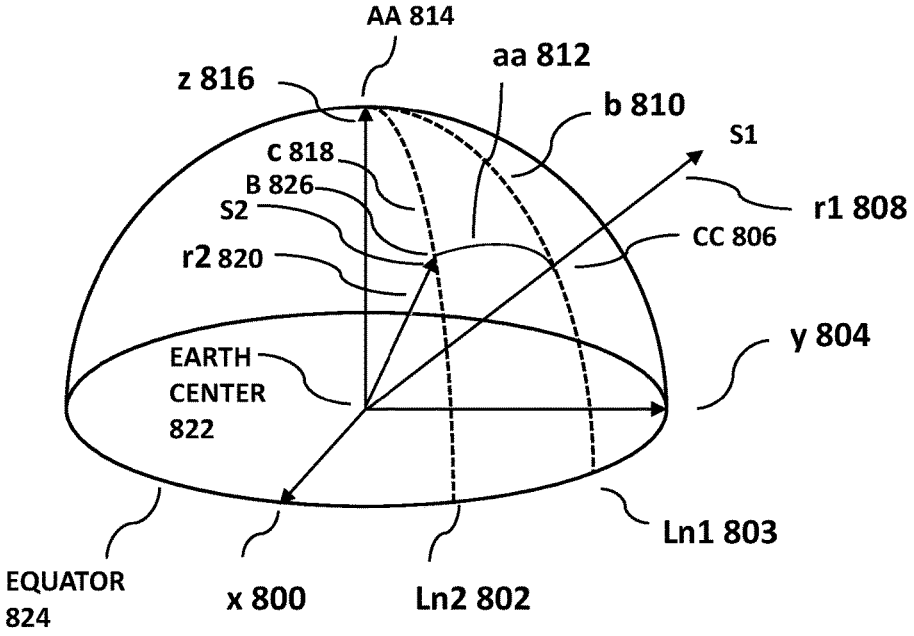
FIG. 6 shows a spherical trigonometry triangle used to compute the angle between the aircraft position vector and the satellite position vector. The spherical triangle is defined by vertices AA, B and C.

As shown in FIG. 6, the airplane position vector r2 820 when it is in the air lies on a great circle during any instant.

When the plane lies on the ground, corrections can be made between the geodetic earth and the spherical earth. The angle between this position vector r2 820 and that of the satellite r1 808 can be found using spherical trigonometry. FIG. 6 shows the relationship between these vectors. The spherical triangle is defined by vertices AA 814, B 826, and CC 806. When the position of the aircraft is given by the GPS system, corrections can be made to follow the geocentric model. The corrections can be the geocentric latitude, the reduced (or parametric) latitude, the rectifying latitude, the conformal latitude and the isometric latitude.

The aircraft elevation angle and the azimuth angle towards the satellite can also be found from the spherical trigonometry relationships. With elevation and azimuth angles, any aircraft rotation in pitch, roll and yaw can be factored in to point the antenna beam to the desired location. As shown in FIG. 6, the angle between the satellite position vector r1 808 and the aircraft position vector r2 820 is aa 812 which can be found from condition (18). b 810 and c 818 are known from the latitudes and AA 814 is know from the difference in longitudes Ln2 802 and Ln1 803. B 826 is the azimuth angled due North. Then:

$$\cos aa = \cos b \cos c + \sin b \sin \cos AA \quad (18);$$

$$\sin B = \sin b \sin AA \sin aa \quad (19);$$

Figure 7:
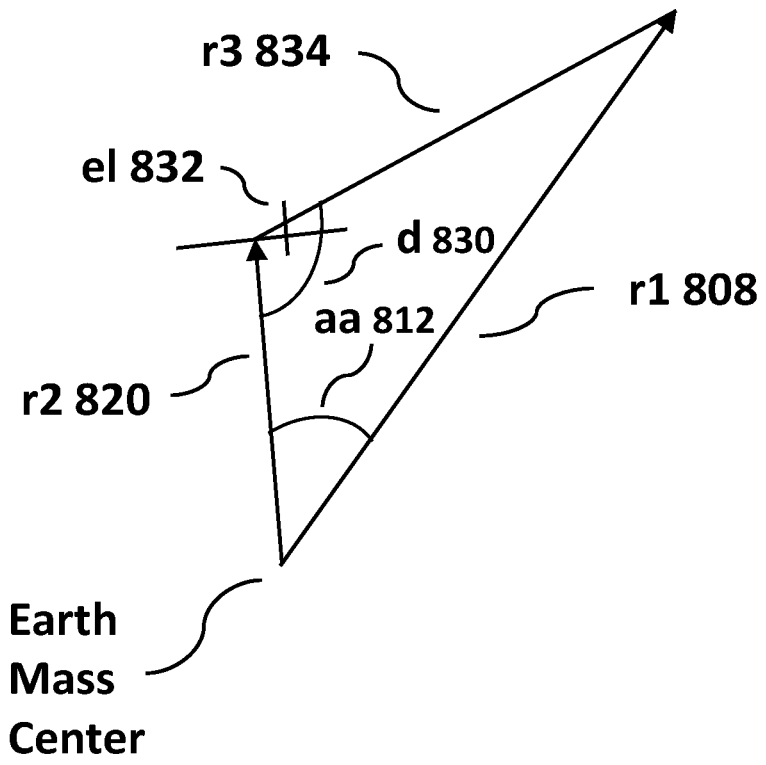
FIG. 7 shows the elevation angle of the range vector.

As shown in FIG. 7, the elevation el 832 can be found by using the position vector of the aircraft r2 820 and the satellite r1 808 and angle aa 812. r3 834 is the distance between the airplane and the satellite and d 830 is the angle between r2 820 and r3 834:

$$r_3^2 = r_1^2 + r_2^2 - 2r_1^2 r_2^2 \cos aa \quad (20);$$

$$\cos d = \frac{(r_3^2 + r_2^2 - r_1^2)}{(2r_3^2 r_1^2)}; \quad (21)$$

$$el = d - 90(\text{deg}) \quad (22).$$

Figure 8:
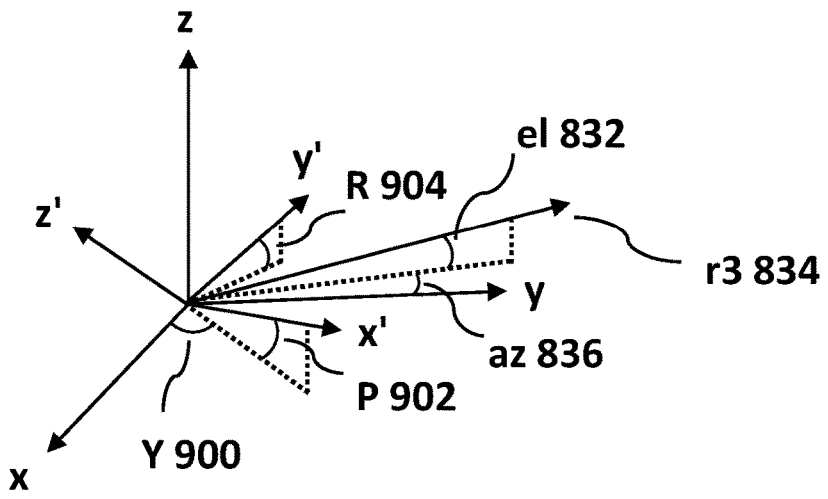
FIG. 8 shows the aircraft local reference axes, the rotation of these axes, and the elevation and azimuth angle of the range vector.

The antenna local basis vectors (x,y,z) in an unrotated aircraft consist of the z axis in the opposite direction of the aircraft position vector, the y axis is in the direction of the right wing and the x axis is in the direction of the aircraft nose, wherein the local x-y plane is perpendicular to the aircraft position vector in the geocentric coordinate system. As shown in FIG. 8, the local basis vectors can be rotated in yaw 900, pitch 902 and roll 904, resulting in rotated basis vectors (x', y', z'). The beam is first corrected in yaw, pitch and roll. Thus, the antenna beam local coordinates are rotated around the z axis in yaw, the y axis in pitch and around the x axis in roll as shown in FIG. 8. These angles can be obtained by readings from the aircraft IRS system. Once the antenna beam has been corrected for these angles, the beam is steered to the elevation angle and the azimuth angle as computed before.

The satellite terminal can receive ephemeris updates from the ground segment or request ephemeris updates. Ephemeris includes the satellite position vector and its associated time. Initial parameters that can be programmed into the terminal then include the initial position of each satellite (i.e. initial Ψ and Ω in equation (8) and initial Ω, ω, and M in equations (12), (13), (14)) and its associated initial time in the orbit. Satellite position and time can be inserted into the orbital equations or motion described above for each satellite.

Beam pointing using the satellite position and aircraft position can be used during initial acquisition, during reacquisition, during satellite handovers, upon communications link loss, or during normal operations. However, the terminal can be designed to measure the satellite received signal strength to track the satellite once the antenna beam is pointed to the satellite and the satellite is acquired using orbital equations of motion and aircraft position. Alternatively, tracking the satellite with signal strength can be used in conjunction to tracking using satellite position and aircraft position.

Figure 9A:
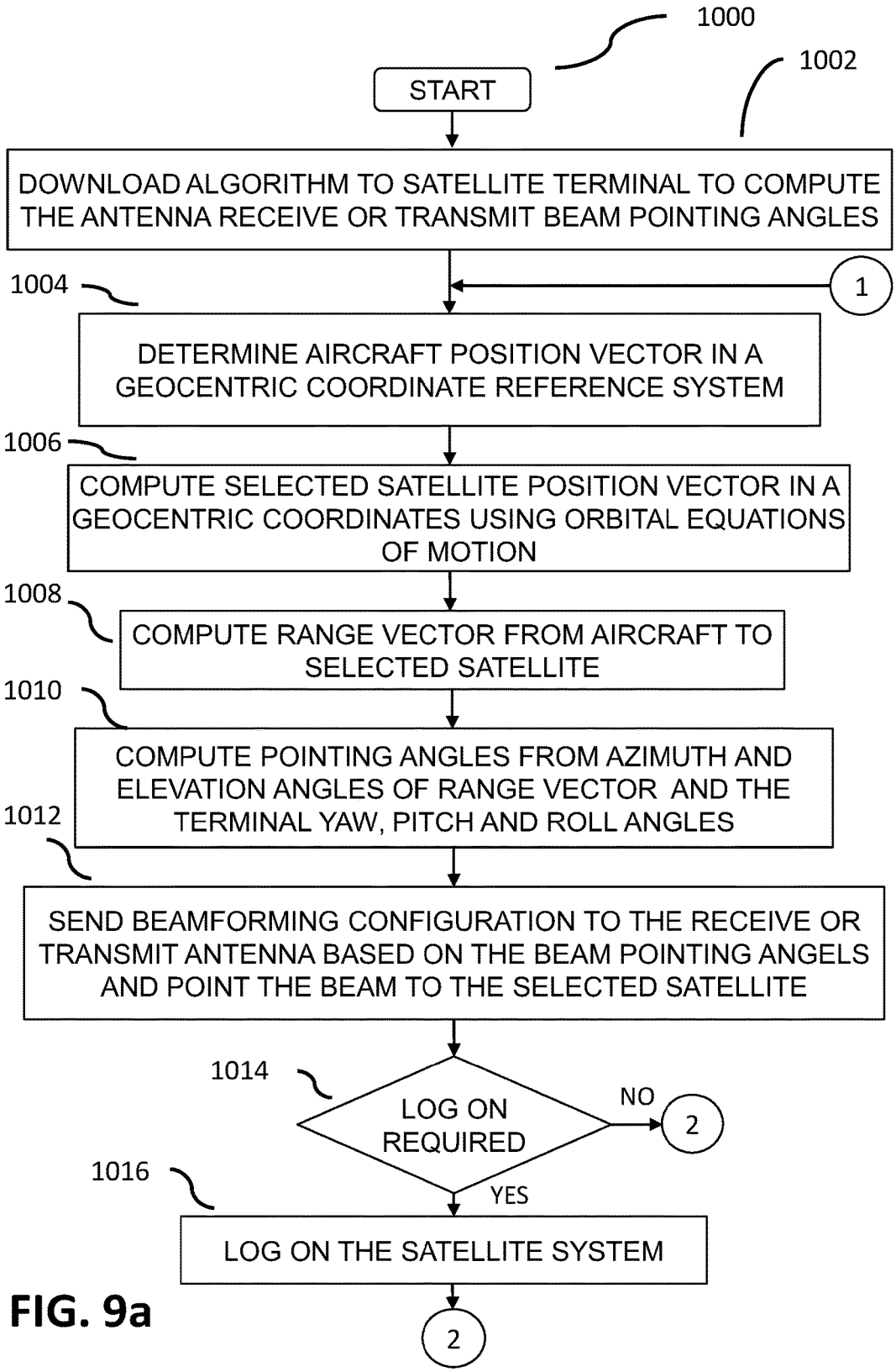
FIG. 9*a* and FIG. 9*b* show a generalized method to point the antenna beams.
Figure 9B:
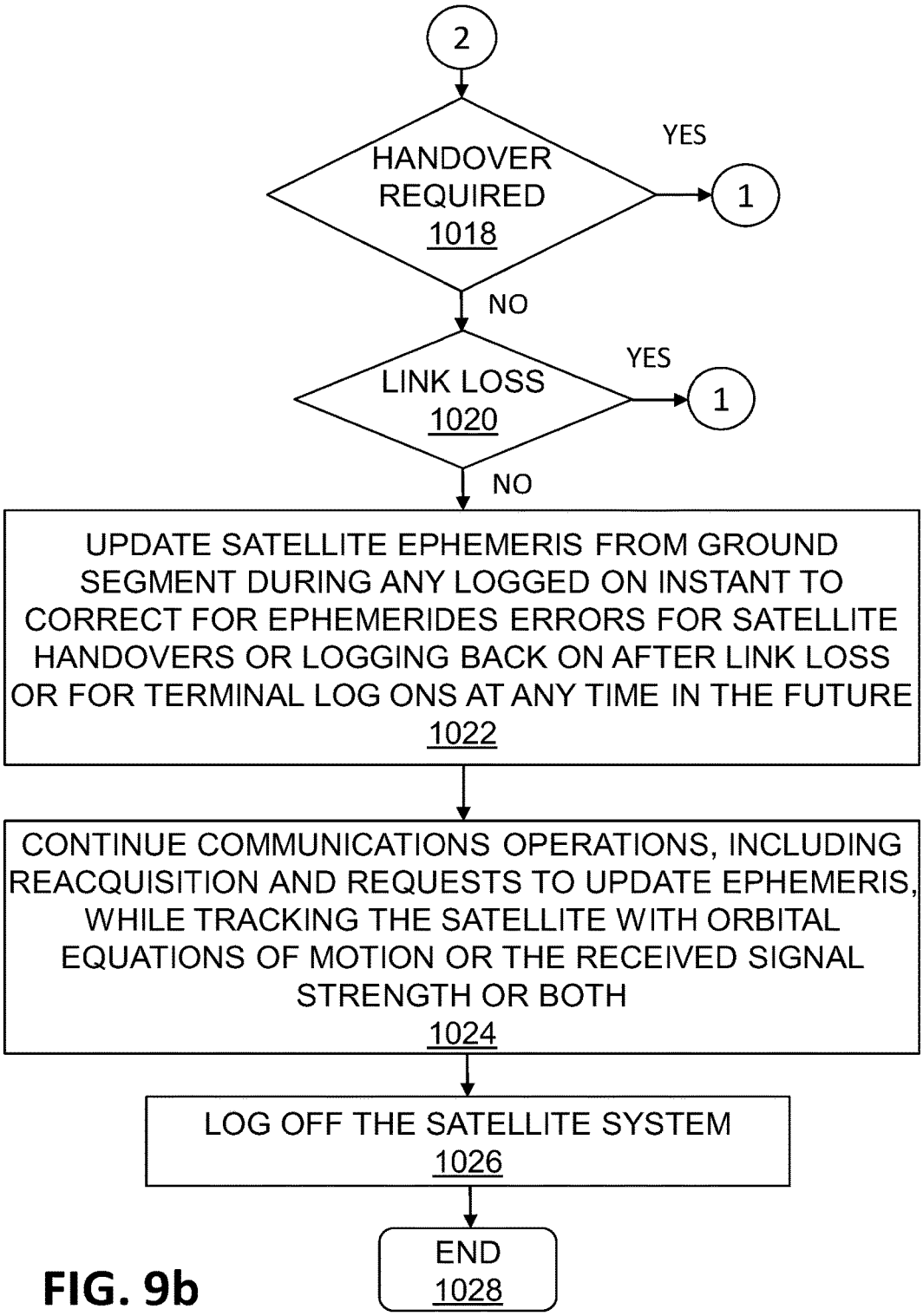

A generalized method is shown in FIG. 9*a* and FIG. 9*b* to compute an aircraft satellite terminal antenna receive beam and transmit beam pointing angles for a satellite system, wherein said satellite system is comprised of a plurality of satellites in a constellation, a ground segment comprised of ground stations and ground data processing units, and a user segment comprised of said satellite terminals, wherein said satellite terminals are each comprised of a processing unit, a modem, a phased array antenna, an antenna control unit (ACU), a downconverter, an upconverter, a clock, an interface to an inertial reference system (IRS), an interface to a GPS receiver, a baseband interface for data communications, and an interface for data loading, the method comprising the steps of: starting communications operations 1000; downloading to the terminal an algorithmic code to compute the receive beam and the transmit beam pointing angles, including the equations for satellite position with initial orbit conditions, wherein the initial conditions are the starting orbital position and time of each satellite in the satellite constellation 1002; at any log on opportunity with the satellite system, determining the aircraft satellite terminal position vector from GPS receivers or IRS, wherein said aircraft satellite terminal position vector is computed using latitude, longitude and altitude, wherein said satellite terminal position vector is calculated in a geocentric coordinate reference system 1004; computing predicted satellite position vector in the geocentric coordinate reference system, using orbital equations of motion, wherein the orbital equations of motion are each estimated by a finite-term algebraic expression to any degree of accuracy, and time information from a GPS input or an internal clock if GPS is not available, wherein the predicted satellite position vector is the position vector of any satellite that is within view of the receive beam or transmit beam scan angle capabilities 1006; computing the range vector from the aircraft satellite terminal to the satellite using spherical trigonometry, wherein the range vector is the satellite position vector minus the aircraft satellite terminal position vector 1008; computing the receive beam or transmit beam pointing angles, wherein the pointing angles are the range vector elevation and azimuth angles with respect to the geocentric coordinate reference system plus the local basis vectors rotations for the aircraft yaw, pitch and roll angles with respect to the geocentric coordinate reference system, wherein the local basis vectors in an unrotated aircraft consist of the z axis in the opposite direction of the aircraft position vector, the y axis in the direction of the right wing of the aircraft and the x axis in the direction of the aircraft nose, wherein the local x-y plane is perpendicular to the aircraft position vector in the geocentric coordinate system 1010; sending beamforming parameters to the antenna for the receive beam and the transmit beam based on the beam pointing angles information and pointing the antenna beams 1012; making a determination whether to log on the satellite system 1014; logging on the satellite system 1016; making a determination whether a handover is required 1018; making a determination whether the communication link is lost 1020; during any logged on instant with the satellite system, updating the satellite ephemeris from information sent by the ground segment, wherein this information is used to correct for any satellite position errors, wherein this information is used for satellite handovers or for logging back on in case the communications link is lost, and wherein this information is used after the aircraft terminal logs off and logs back on at any time in the future 1022; continuing communications operations, including satellite reacquisition and requests to update ephemeris, while tracking the satellite with orbital equations of motion or the beacon received signal strength or both 1024; logging off the satellite system 1026; ending communications operations 1028.

The aircraft local x-y plane is parallel to the transmit or receive antenna plane when the antennas are flat. Each antenna is installed on top and of the fuselage. Other installation configurations are possible so each antenna orientation with respect to the aircraft local basis vectors has to be defined.

Initial position algorithm conditions can also be provided before starting operation from a current system database that could be a website.

The method described herein can be used for ground or ship-borne terminals. The local basis vectors can be defined with the z axis in the opposite direction of the position vector defined in the geocentric coordinate system, the y axis in the South direction and the x axis in the East direction. In this case, the local x-y plane lies on the plane of the receive or transmit antenna perpendicularly to the position vector. Any rotations of these basis vectors with respect to the geocentric coordinate system is taken into account when computing the receive or transmit beam pointing angles, using the azimuth and elevation angles of the range vector.

The satellite terminal antenna can also be mechanically steered with drive motors. These motors can be actuated by the antenna control unit 120. Also, the antenna could be a hybrid type, having transmit and receive beamforming capabilities and mechanical steering.

Typical phased-array antennas are described in "DEVELOPMENT OF 61-CHANNEL DIGITAL BEAM-FORMING (DBF) TRANSMITTER ARRAY FOR MOBILE SATELLITE COMMUNICATION", G. Liang et al, Progress In Electromagnetics Research, PIER 97, 177-195, 2009.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

The invention claimed is:

1. An antenna beam pointing system for a satellite system for pointing autonomously, without any information from external inputs, the transmit or the receive beam of a phased array antenna, wherein said satellite system is comprised of a plurality of satellites in a constellation, a ground segment comprised of ground stations and ground data processing units, and a user segment comprised of satellite terminals, wherein said satellite terminals are each comprised of a processing unit, a modem, a phased array antenna, an antenna control unit (ACU), a downconverter, an upconverter, a clock, an interface to an inertial reference system (IRS), an interface to a GPS sensor, a baseband interface for data communications, and an interface for data loading, the antenna beam pointing system comprised of:

the processing unit configured inside said satellite terminal to host a beam pointing software algorithm;

wherein said processing unit is configured with an interface to said antenna control unit to send pointing angle information computed by said software algorithm to calculate the receive or transmit beamforming parameters of said antenna;

wherein said processing unit is configured with an interface to said modem to receive ephemeris updates from the ground segment;

wherein said processing unit is configured with an interface to said modem to send commands to the ground segment to request ephemeris updates;

wherein said processing unit is configured with said data loading interface for data loading;

wherein said software algorithm is comprised of computer executable instructions wherein the instructions are executed by processing logic to:

compute, on the order of microseconds, autonomously and indefinitely for the lifetime of each satellite in the constellation, the receive beam or transmit beam pointing angles of said antenna;

compute at any log on opportunity with the satellite system the platform position vector from GPS receivers or IRS information, wherein said platform position vector is computed using latitude, longitude and altitude, wherein said platform position vector is calculated in a geocentric coordinate reference system;

compute, autonomously and indefinitely without any information from external inputs, predicted satellite position vectors in the geocentric coordinate reference system, using orbital equations of motion and time information from a GPS input or an internal clock if GPS is not available, wherein the orbital equations of motion are estimated by a finite-term algebraic expression to any degree of accuracy, wherein said predicted satellite position vectors are the satellite position vectors of the corresponding satellites that are within view of the receive beam or transmit beam scan angle capabilities; wherein each satellite in said constellation follows a near-ideal orbit by countering the effects of orbital decay with their autonomous station keeping mechanisms and maintaining itself within an orbital uncertainty volume indefinitely for its orbital lifetime; wherein the orbital equations of motion are computed on the order of micro seconds, given the finite-term algebraic expression;

wherein the orbital equations of motion are exemplified by conditions (1), (2), (3) and (4) for first order secular perturbation $$\omega_{ave}=\omega_o+\tfrac{3}{4}J_2(R/p)^2(4-5\sin^2 i)n_{ave}t \quad (1)$$

$$\Omega_{ave}=\Omega_o+3/2J_2(R/p)^2n_{ave}t\cos i \quad (2)$$

$$M_{ave}=M_o+n_{ave}t \quad (3)$$

$$n_{ave}=n_o+3/2J_2(R/p)^2n_o(1-3/2\sin^2 i)(1-e^2)^{1/2} \quad (4);$$

wherein t is time; R is the Earth's radius; i is the inclination of the plane; e is the eccentricity of the orbital ellipse; Ω is the longitude of the node; M is the mean anomaly; ω argument of perigee; μ is the Earth gravitational parameter; p is the semi lactus rectum; no is the unperturbed mean motion; and $J_2$ is a gravity perturbation constant;

wherein the orbital equations of motion can also be exemplified by perturbations of any order to any degree of accuracy by any number of algebraic terms;

compute autonomously, on the order of microseconds, the initial orbit conditions for said predicted satellite position vectors, wherein said initial conditions are the starting predicted satellite position vector and corresponding starting time of each satellite in the satellite constellation;

compute autonomously, on the order of microseconds, the range vector from the platform to the satellite using spherical trigonometry wherein said range vector is the satellite position vector minus the platform position vector;

compute autonomously, on the order of microseconds, said receive beam and said transmit beam pointing angle, wherein the pointing angles are said range vector elevation and azimuth angles with respect to the geocentric coordinate reference system plus the local basis vectors rotations for the platform yaw, pitch and roll angles with respect to the geocentric coordinate reference system, wherein the local basis vectors in an unrotated platform consist of the z axis directed in the opposite direction of the platform position vector, the y axis directed towards the right side of the platform and the x axis directed towards the platform front, wherein the local x-y plane is perpendicular to the platform position vector;

send pointing angle information to the antenna control unit to calculate the receive beam and transmit beam beamforming parameters of said antenna;

wherein the low latency computation of each satellite position vector and the antenna pointing angles information adapts the terminal to form the transmit or receive beam toward any satellite in less than 0.3 seconds during initial communications operations; wherein the low latency computation of each satellite position vector and the antenna pointing angles information adapts the terminal to form the transmit or receive beam toward any satellite in less than 0.3 seconds during handover operations; wherein the low latency computation of each satellite position vector and the antenna pointing angles information adapts the terminal to form the transmit or receive beam toward any satellite in less than 0.3 seconds during reacquisition operations;

receive and process ephemeris updates from the ground segment relayed by the modem to update the orbital equations of motion in cases where satellites deviate from their nominal positions;

and send commands to the ground segment relayed by the modem to request ephemeris updates in cases where satellites deviate from their nominal positions.

2. A method to compute a platform satellite terminal antenna receive beam and transmit beam pointing angles for a satellite system, wherein said satellite system is comprised of a plurality of satellites in a constellation, a ground segment comprised of ground stations and ground data processing units, and a user segment comprised of said satellite terminals, wherein said satellite terminals are each comprised of a processing unit, a modem, a phased array antenna, an antenna control unit (ACU), a downconverter, an upconverter, a clock, an interface to an inertial reference system (IRS), an interface to a GPS receiver, a baseband interface for data communications, and an interface for data loading, the method comprising the steps of: starting communications operations; downloading to the terminal an algorithmic code to compute the receive beam and the transmit beam pointing angles autonomously and indefinitely for the life time of each satellite in the constellation, including the equations for satellite position with initial orbit conditions, wherein the initial conditions are the starting orbital position and time of each satellite in the satellite constellation; at any log on opportunity with the satellite system, determining the platform satellite terminal position vector from GPS receivers or IRS, wherein said platform satellite terminal position vector is computed using latitude, longitude and altitude, wherein said satellite terminal position vector is calculated in a geocentric coordinate reference system; computing the predicted satellite position vector in the geocentric coordinate reference system, using orbital equations of motion, wherein the orbital equations of motion are each estimated by a finite-term algebraic expression to any degree of accuracy for any gravity perturbation order, and time information from a GPS input or an internal clock if GPS is not available, wherein the predicted satellite position vector is the position vector of any satellite that is within view of the receive beam or transmit beam scan angle capabilities; wherein each satellite in said constellation follows a near-ideal orbit by countering the effects of orbital decay with their autonomous station keeping mechanisms and maintaining itself within an orbital uncertainty volume indefinitely for its orbital lifetime; wherein the orbital equations of motion are computed on the order of micro seconds, given the finite-term algebraic expression; computing on the order of microseconds the range vector from the platform satellite terminal to the satellite using spherical trigonometry, wherein the range vector is the satellite position vector minus the platform satellite terminal position vector; computing on the order of microseconds the receive beam or transmit beam pointing angles, wherein the pointing angles are the range vector elevation and azimuth angles with respect to the geocentric coordinate reference system plus the local basis vectors rotations for the platform yaw, pitch and roll angles with respect to the geocentric coordinate reference system, wherein the local basis vectors in an unrotated platform consist of the z axis in the opposite direction of the platform position vector, the y axis in the direction of the right side of the platform and the x axis in the direction of the platform front, wherein the local x-y plane is perpendicular to the platform position vector in the geocentric coordinate system; sending beamforming parameters to the antenna for the receive beam and the transmit beam based on the beam pointing angles information and pointing the antenna beams; wherein the low latency computation of each satellite position vector and the antenna pointing angles information adapts the terminal to form the transmit or receive beam toward any satellite in less than 0.3 seconds during initial communications operations; wherein the low latency computation of each satellite position vector and the antenna pointing angles information adapts the terminal to form the transmit or receive beam toward any satellite in less than 0.3 seconds during handover operations; wherein the low latency computation of each satellite position vector and the antenna pointing angles information adapts the terminal to form the transmit or receive beam toward any satellite in less than 0.3 seconds during reacquisition operations; making a determination whether to log on the satellite system; logging on the satellite system; making a determination whether a handover is required; making a determination whether the communication link is lost; during any logged on instant with the satellite system, updating the satellite ephemeris from information sent by the ground segment in cases where satellites deviate from their nominal positions, wherein this information is used for satellite handovers or for logging back on in case the communications link is lost, and wherein this information is used after the platform terminal logs off and logs back on at any time in the future; continuing communications operations, including satellite reacquisition and requests to update ephemeris in cases where satellites deviate from their nominal positions, while tracking the satellite with orbital equations of motion or the beacon received signal strength or both; logging off the satellite system; ending communications operations.

3. An antenna beam pointing system for a satellite system for pointing autonomously, without any information from external inputs, the transmit or the receive beam of an antenna wherein said satellite system is comprised of a plurality of satellites in a constellation, a ground segment comprised of ground stations and ground data processing units, and a user segment comprised of satellite terminals, wherein said satellite terminals are each comprised of a processing unit, a modem, an antenna, an antenna control unit (ACU), a downconverter, an upconverter, a clock, an interface to an inertial reference system (IRS), an interface to a GPS sensor, a baseband interface for data communications, and an interface for data loading, the antenna beam pointing system comprised of:

the processing unit configured inside said satellite terminal to host a beam pointing software algorithm;

wherein said processing unit is configured with an interface to said antenna control unit to send pointing angle information computed by said software algorithm to calculate the antenna look angles;

wherein said processing unit is configured with an interface to said modem to receive ephemeris updates from the ground segment;

wherein said processing unit is configured with an interface to said modem to send commands to the ground segment to request ephemeris updates;

wherein said processing unit is configured with said data loading interface for data loading;

wherein said software algorithm is comprised of computer executable instructions wherein the instructions are executed by processing logic to:

compute, on the order of microseconds, autonomously and indefinitely for the lifetime of each satellite in the constellation, the pointing angles of said antenna;

compute at any log on opportunity with the satellite system the platform position vector from GPS receivers or IRS information, wherein said platform position vector is computed using latitude, longitude and altitude, wherein said platform position vector is calculated in a geocentric coordinate reference system;

compute, autonomously and indefinitely without any information from external inputs, predicted satellite position vectors in the geocentric coordinate reference system, using orbital equations of motion and time information from a GPS input or an internal clock if GPS is not available, wherein the orbital equations of motion are estimated by a finite-term algebraic expression to any degree of accuracy, wherein said predicted satellite position vectors are the satellite position vectors of the corresponding satellites that are within view of the receive beam or transmit beam scan angle capabilities; wherein each satellite in said constellation follows a near-ideal orbit by countering the effects of orbital decay with their autonomous station keeping mechanisms and maintaining itself within an orbital uncertainty volume indefinitely for its orbital lifetime;

wherein the orbital equations of motion are computed on the order of micro seconds, given the finite-term algebraic expression;

wherein the orbital equations of motion are exemplified by conditions (1), (2), (3) and (4) for first order secular perturbation $$\omega_{ave}=\omega_o+\tfrac{3}{4}J_2(R/p)^2(4\text{-}5\sin^2 i)n_{ave}t \quad (1)$$

$$\Omega_{ave}=\Omega_o+3/2J_2(R/p)^2n_{ave}t\cos i \quad (2)$$

$$M_{ave}=M_o+n_{ave}t \quad (3)$$

$$n_{ave}=n_o+3/2J_2(R/p)^2n_o(1-3/2\sin^2 i)(1-e^2)^{1/2} \quad (4);$$

wherein t is time; R is the Earth's radius; i is the inclination of the plane; e is the eccentricity of the orbital ellipse; Ω is the longitude of the node; M is the mean anomaly; ω argument of perigee; μ is the Earth gravitational parameter; p is the semi lactus rectum; $n_o$ is the unperturbed mean motion; and $J_2$ is a gravity perturbation constant;

wherein the orbital equations of motion can also be exemplified by perturbations of any order perturbations to any degree of accuracy by any number of algebraic terms;

compute autonomously, on the order of microseconds, the initial orbit conditions for said predicted satellite position vectors, wherein said initial conditions are the starting predicted satellite position vector and corresponding starting time of each satellite in the satellite constellation;

compute autonomously, on the order of microseconds, the range vector from the platform to the satellite using spherical trigonometry wherein said range vector is the satellite position vector minus the platform position vector;

compute autonomously, on the order of microseconds, said receive beam and said transmit beam pointing angle, wherein the pointing angles are said range vector elevation and azimuth angles with respect to the geocentric coordinate reference system plus the local basis vectors rotations for the platform yaw, pitch and roll angles with respect to the geocentric coordinate reference system, wherein the local basis vectors in an unrotated platform consist of the z axis directed in the opposite direction of the platform position vector, the y axis directed towards the right side of the platform and the x axis directed towards the platform front, wherein the local x-y plane is perpendicular to the platform position vector;

send pointing angle information to the antenna control unit to calculate the pointing angles of said antenna;

wherein the low latency computation of each satellite position vector and the antenna pointing angles information adapts the terminal to form the transmit or receive beam toward any satellite in less than 0.3 seconds during initial communications operations; wherein the low latency computation of each satellite position vector and the antenna pointing angles information adapts the terminal to form the transmit or receive beam toward any satellite in less than 0.3 seconds during handover operations; wherein the low latency computation of each satellite position vector and the antenna pointing angles information adapts the terminal to form the transmit or receive beam toward any satellite in less than 0.3 seconds during reacquisition operations;

receive and process ephemeris updates from the ground segment relayed by the modem to update the orbital equations of motion in cases where satellites deviate from their nominal positions;

and send commands to the ground segment relayed by the modem to request ephemeris updates in cases where satellites deviate from their nominal positions.

4. The antenna beam pointing system in claim 3 wherein the antenna consists of a mechanically-steered antenna.

5. The antenna beam pointing system in claim 3 wherein the antenna consists of a hybrid antenna configured with a mechanically-steered mechanism and a beamforming phased array.

* * * * *